US005221288A

United States Patent [19]

Kamata et al.

[11] Patent Number: 5,221,288

[45] Date of Patent: Jun. 22, 1993

[54] THERMOCHROMIC DYEING METHOD AND CELLULOSE PRODUCT DYED THEREBY

[75] Inventors: Masayasu Kamata, Kusatsu; Osamu Sasaki; Shouzou Suefuku, both of Ohtsu; Tatsuya Maeda, Kyoto, all of Japan

[73] Assignee: Matsui Shikiso Chemical Co., Ltd., Kyoto, Japan

[21] Appl. No.: 670,747

[22] Filed: Mar. 15, 1991

[30] Foreign Application Priority Data

Oct. 9, 1990 [JP] Japan ..... 2-271164

[51] Int. Cl.[5] ..... C09B 67/00; D06P 1/00

[52] U.S. Cl. ..... 8/554; 8/490; 8/550; 8/556; 8/606; 8/918

[58] Field of Search ..... 8/554, 556, 606, 550, 8/490

[56] References Cited

U.S. PATENT DOCUMENTS

| | | | |
|---|---|---|---|
| 4,289,497 | 9/1981 | Hovey | 8/506 |
| 4,880,667 | 11/1989 | Welch | 8/471 |
| 4,931,067 | 6/1990 | Swidler | 8/657 |

*Primary Examiner*—A. Lionel Clingman
*Attorney, Agent, or Firm*—McGlew and Tuttle

[57] ABSTRACT

A dyeing method comprising a process of treating a cellulose fiber textile product with cationic compound and another process of treating the thus-treated textile product by immersing it in a dispersion containing thermochromic material and/or photochromic material.

40 Claims, No Drawings

THERMOCHROMIC DYEING METHOD AND CELLULOSE PRODUCT DYED THEREBY

BACKGROUND OF THE INVENTION

1. Field of the Invention

The present invention relates to a method of dyeing a cellulose fiber textile product with a thermochromic material and/or a photochromic material and the product dyed by the method.

2. Description of the Prior Art

A three-component composition consisting of an acid developing substance, an acidic substance and a solvent has been well known as a kind of thermochromic material which shows reversible color changes as the temperature changes.

This composition is capable of producing commercial products having increased value in chromatic effect and function since it offers more diverse colors and higher coloring densities in comparison with thermochromic materials such as metal complex crystals and cholesteric liquid crystals and since dramatic changes occur between colored and colorless states. At present, the three-component composition described above is used in a microcapsular form except for only a very few uses, in order to keep its function unaffected by outside conditions since its excellent color changing function is obtained only in cases where its three components form a system at a strictly constant ratio.

With respect to photochromic materials, which show reversible color changes in the presence or absence of light, a wide variety of organic photochromic compounds have been developed which show more sensitive color changes between colored and colorless states, which offer more diverse colors and which are more compatible with various organic compounds such as synthetic resins in comparison with conventional inorganic photochromic compounds such as silver halides.

Such organic photochromic compounds are used as a solution or dispersion in an appropriate medium or in the form of microcapsules of a solution or dispersion in an appropriate medium.

None of these thermochromic materials and photochromic materials are capable of directly dyeing fiber because of a lack of affinity with fiber. Although dyeing is possible by the synthetic resin printing method, the synthetic resin padding method and other methods using an adhesive such as synthetic resin binder, the coloring density obtained with thermochromic material or photochromic material is extremely, i.e. markedly, lower than that obtained with an ordinary coloring agent. For example, in the case of the synthetic resin printing method, a fair coloring density is obtained only when bulky printing is conducted on a textile product using an ink containing such chromic material and synthetic resin binder at high concentrations. In this case, the surface of the textile product loses its fiber texture, its appearance worsens, and its color fastness to rubbing and color fastness to washing are insufficient. For these reasons, even when the entire surface of the cloth is colored, no commercially valuable product will be obtained. Therefore, it is the conventional practice to make patterns such as one-point patterns on a very narrow area on the cloth.

Also, when using the pigment resin padding method with high concentrations of thermochromic material and/or photochromic material and synthetic resin binder, these chromic materials are not capable of being thoroughly adsorbed because of a lack of substantivity with fiber, and physical adhesion as in the pigment resin printing method cannot be expected; therefore, nothing more than extremely low coloring density can be obtained. Moreover, the obtained fiber texture, appearance, color fastness to rubbing, and other properties are insufficient.

SUMMARY OF THE INVENTION

The object of the present invention is to provide a dyeing method which permits dyeing of a cellulose fiber textile product with thermochromic material and/or photochromic material to high densities which could not be obtained by any conventional method and which thus provides incomparably distinct colors for the materials upon their color development with no influence on the texture, appearance or other textile product properties The object described above can be accomplished by the dyeing method of the present invention, which comprises a process of treating a cellulose fiber textile product with a cationic compound and another process of treating the thus-treated textile product by immersing it in a dispersion containing thermochromic material and/or photochromic material.

A preferred mode of the dyeing method of the present invention comprises a process of treating a cellulose fiber textile product with a cationic compound, another process of treating the thus-treated textile product by immersing it in a dispersion containing thermochromic material and/or photochromic material, and still another process of further treating the textile product by adding a binder to the resulting residual dispersion after the immersing in an amount insufficient to spoil the appearance and handling touch of the dyed product.

Another preferred mode of the dyeing method of the present invention comprises a process of treating a cellulose fiber textile product with a cationic compound, another process of treating the thus-treated textile product by immersing it in a dispersion containing thermochromic material and/or photochromic material, and still another process of further treating the textile product by immersing it in water containing a binder in an amount insufficient to spoil the appearance and handling touch of the dyed product.

Still another preferred mode of the dyeing method of the present invention comprises a process of treating a cellulose fiber textile product with a cationic compound and another process of treating the thus-treated textile product by immersing it in a dispersion containing a thermochromic material and/or photochromic material and (b) a binder in an amount insufficient to spoil the appearance and handling touch of the dyed product.

Still another preferred mode of the dyeing method of the present invention comprises a process of treating a cellulose fiber textile product with a cationic compound and a binder in an amount insufficient to spoil the appearance and touch of the dyed product and another process of treating the thus-treated textile product by immersing it in a dispersion containing thermochromic material and/or photochromic material.

These modes of embodiment provide further improvements in the color fastness to rubbing and color fastness to washing in dyeing.

DETAILED DESCRIPTION OF THE INVENTION

As stated above, the dyeing method of the present invention comprises a process of treating a cellulose fiber textile product with a cationic compound and another process of treating the thus-treated textile product by immersing it in a dispersion containing thermochromic material and/or photochromic material.

Cellulose Fiber and Textile Products

Examples of the cellulose fiber for the present invention include natural fibers such as cotton and hemp and regenerated fibers such as rayon and cupra.

Examples of the cellulose fiber textile product described above include cellulose fiber yarns, blended yarns of cellulose fiber with polyester fiber, acrylic fiber, wool, etc., or fabrics or knits comprising cellulose fiber yarn and/or the blended yarn described above, cellulose-containing nonwoven fabrics, and sewn products such as apparels based on these fabrics, knits or nonwoven fabrics.

Cationic Compound

Examples of the cationic compound described above include cationic compounds of the quaternary ammonium salt type, those of the pyridinium salt type, those of the dicyandiamide type those of the polyamine type, and those of the polycation type.

Examples of cationic compounds of the quaternary ammonium salt type include quaternary ammonium salt type cationic surfactants such as trimethyloctadecylammonium chloride, trimethylhexadecylammonium chloride, trimethyllaurylammonium chloride, dimethyllaurylammonium chloride, laurylmethylammonium chloride, stearyltrimethylammonium chloride, lauryldimethylbenzylammonium chloride, lauryltrimethylammonium chloride, alkylbenzyldimethylammonium chloride stearylbenzyldimethylammonium chloride and alkyltrimethylammonium chloride; 2,3-epoxypropyltrimethylammonium chloride, 3-chloro-2-hydroxypropyltrimethylammonium chloride, pyridinium salt type surfactant such as laurylpyridinium chloride and stearylamide methylpyridinium chloride; quaternary ammonium salt compounds having a triazine ring as disclosed in Japanese Patent Publication Open to Public Inspection Nos. 155285/1977 and 155286/1977, 2-hydroxy-3-methacryloxypropyltrimethylammonium chloride, 2-methacryloxyethyltrimethylammonium chloride, 2-methacryloxyethyltrimethylammonium metasulfate, p-vinylbenzyltrimethylammonium chloride, (meth)acrylamidoethyldiethylammonium metasulfate, (meth)acrylamidopropyldimethylhydroxyethylammonium chloride, (meth)acrylamidoethyldiethylglycidylammonium chloride, (meth)acrylamidopropyldimethylallylammonium chloride (meth)acrylamidoethyldiethylmethoxymethylammonium chloride, 2-heptadecyl-1-ethyl-[(2-octadecanoylamino)ethyl]imidazoliniumethyl sulfate 2-heptadecyl-1-methyl 1-[(2-hexadecanoylamino)ethyl]imidazoliniummethyl sulfate, and 1,3-bis(3-chloro-2-hydroxypropyl-)imidazolinium dichloride.

Examples of cationic compounds of the dicyandiamide type include formalin condensation products of dicyandiamide.

Examples of cationic compounds of the polyamine type include guanidine derivative condensation products of polyalkylenepolyamine.

Examples of cationic compounds of the polycation type include poly-4-vinylpyridine hydrochloride, tertiary amine polymers such as the polyacrylonitrile polymers disclosed in Japanese Patent Publication Open to Public Inspection No. 64186/1979, the polymers of the quaternary ammonium salt type such as 2-hydroxy-3-methacryloxypropyltrimethylammonium chloride, 2-methacryloxyethyltrimethylammonium chloride, 2-methacryloxyethyltrimethylammonium metasulfate, p-vinylbenzyltrimethylammonium chloride, (meth)acrylamidoethyldiethylammonium metasulfate, (meth)acrylamidopropyldimethylhydroxyethylammonium chloride, (meth)acrylamidoethyldiethylglycidylammonium chloride, (meth)acrylamidopropyldimethylallylammonium chloride, (meth)acrylamidoethyldiethylmethoxymethylammonium chloride, copolymers of the quaternary ammonium salts described above and other vinyl monomers, and quaternary ammonium salt polymers such as the polymer comprising the following monomer unit:

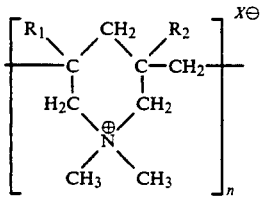

disclosed in Japanese Patent Publication Open to Public Inspection No. 128382/1981, the polymer comprising the following monomer unit:

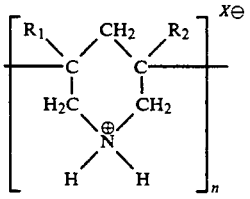

disclosed in Japanese Patent Publication Open to Public Inspection No. 11288/1982, and the polymer comprising the following monomer unit:

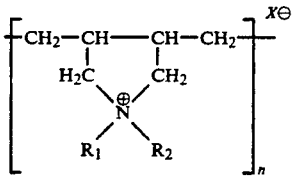

SHALLOL DC (trade name) series, product of Daiichi Kogyo Seiyaku Co., Ltd.).

Of these cationic compounds, polyamine type, dicyanogen type and quaternary ammonium salt polymers and copolymers of the quaternary ammonium salts and other vinyl monomers of the polycation type are particularly effective for the present invention.

Thermochromic Material

It is desirable to use a microcapsuled three-component mixture of an acid developing substance, an acidic substance and a solvent as the thermochromic material for the present invention.

Examples of the acid developing substance described above include triphenylmethanephthalide compounds, phthalide compounds, phthalan compounds, Acyl Leucomethylene Blue compounds, fluoran compounds, triphenylmethane compounds, diphenylmethane compounds and spiropyran compounds. More specific examples thereof include 3,3'-dimethoxyfluoran, 3,3'-dibutoxyfluoran, 3-chloro-6-phenylaminofluoran, 3-diethylamino-6-methyl-7-chlorofluoran, 3-diethyl-7,8-benzofluoran, 3,3',3''-tris(p-dimethylaminophenyl)phthalide, 3,3'-bis(p-dimethylaminophenyl)phthalide and 3-diethylamino-7-phenylaminofluoran.

Examples of the acidic substance described above include 1,2,3-benzotriazoles, phenols and oxy aromatic carboxylic acids. More specific examples thereof include 5-chlorobenzotriazole, 5-butylbenzotriazole, bisbenzotriazole-5-methane, 5-oxybenzotriazole, phenol, nonylphenol, bisphenol A, bisphenol F, 2,2'-bisphenol, β-naphthol 1 5-dihydroxynaphthalene, resorcinol, catechol, pyrogallol and phenol resin oligomers.

Examples of the solvent described above include alcohols, alcohol-acrylonitrile adducts, azomethine and esters. More specific examples thereof include decyl alcohol, lauryl alcohol, myristyl alcohol, cetyl alcohol, stearyl alcohol, behenyl alcohol, lauryl alcohol-acrylonitrile adducts, myristyl alcohol-acrylonitrile adducts, stearyl alcohol-acrylonitrile adducts, benzylidene-p-toluidine, benzylidene-butylamine, p-methoxybenzylideneaniline, and esters such as octyl caprylate, decyl caprylate, myristyl caprylate, decyl laurate, lauryl laurate, myristyl laurate, decyl myristate, lauryl myristate, cetyl myristate, lauryl palmitate, cetyl palmitate, stearyl palmitate, glycerol monostearate, glycerol monooleate cetyl p-t-butylbenzoate, stearyl 4-methoxybenzoate, dilauryl thiodipropionate dimyristyl thiodipropionate, benzyl thiodipropionbenzoate, distearyl thiodipropionate, benzyltrilaurate benzoate, pentaerythritol tetrastearate and pentaerythritol tetramyristate.

Microcapsulation of Thermochromic Material

The three-component mixture described above can be microcapsuled by, for example, the following method. A mixture comprising three components selected from the respective groups of the compounds described above is first made molten under heating conditions to yield an oily product. This oily product is added to water containing a surfactant a protective colloid, a pH regulator, an electrolyte and other substances added as needed, followed by dispersion or emulsification while maintaining an agitation speed such that the grain size of the oil drops becomes 1 to 50 μm, preferably 2 to 20 μm. Then, a coat former is added and the oily product is microcapsuled by a known capsulation method such as the interfacial polymerization method, the insight polymerization method or the coacervation method. The coat former described above may be added in any stage rather than immediately after the grain size adjustment described above or may be added in separate portions.

As the coat former described above, it is possible to use one or more kinds of polymer compounds such as polyurea, polyamide, polyester, polyurethane, epoxy resin, urea resin, melamine resin, gelatin, ethyl cellulose, polystyrene and polyvinyl acetate.

In addition, the surface of the microcapsule incorporating the three-component mixture described above may be coated with a crosslinked initial condensation product of urea resin or melamine resin, epoxy resin, formaldehyde or an isocyanate compound thereby forming a double coated fine particle.

It is preferable that the coat for the microcapsule described above be thermosetting because of the excellent heat resistance thereof.

Photochromic Material

As the photochromic material for the present invention, it is desirable to use an organic photochromic compound in the form of a matrix or microcapsules. The matrix can be obtained by dispersing the compound in an appropriate medium. The microcapsule can be obtained by microcapsulating the organic photochromic material in solution or as a fine grain dispersion in a medium in a similar manner as described above.

Examples of the organic photochromic compound described above include azobenzene compounds, thioindigo compounds, dithizone metal complexes, spiropyran compounds, spirooxazine compounds, naphthopyran compounds, fulgide compounds, dihydroprene compounds, spirothiopyran compounds, 1,4-2H-oxazine, triphenylmethane compounds and viologen compounds, with preference given to spiropyran compounds, spirooxazine compounds and fulgide compounds for the dyeing method of the present invention.

Examples of specific organic photochromic compounds include 1,3,3-trimethylspiro[indolino-2,3'-(3H)naphtho(2,1-b)(1,4)-oxazine], 5-methoxy-1,3,3-trimethylspiro[indolino-2,3'-(3H)naphtho(2,1-b)(1,4)-oxazine], 5-chloro-1,3,3-trimethylspiro[ indolino-2,3'-(3H)naphtho(2,1-b)(1,4)-oxazine], 8'-piperidino-1,3,3-trimethylspiro[indolino-2,3'-(3H)naphtho(2,1-b)(1,4)-oxazine], 1-benzyl-3,3-dimethylspiro[indolino-2,3'-(3H)naphtho(2,1-b)(1,4)-oxazine], 1,3,5,6-tetramethyl-3-ethylspiro[indolino-2,3'-(3H)naphtho(2,1-b)(1,4)-oxazine], 1,3,3,5,6-pentamethylspiro[indolino-2,3'-(3H)naphtho(2,1-b)(1,4)-oxazine], 1,3',3'-trimethylspiro(2H-1-benzopyran-2,2'-indolino), 3,3,1-diphenyl-3H-naphtho-(2,1-13)pyran, 1,3,3-triphenylspiro[indolino-2,3'-(3H)naphtho(2,1-b)pyran], 1-(2,3,4,5,6-pentamethylbenzyl)-3,3-dimethylspiro[indolino-2,3'-(3H)-naphtho(2,1-b)pyran], 1-(2-nitrobenzyl)-3,3-dimethylspiro[indolino-2,3'-(3H)-naphtho(2,1-b)pyran], 1,1-diphenylnaphthopyran, 2,5-dimethylfuryl-trimethylfulgide and 2-methyl-5-chlorotrimethylfulgide.

Matrix Medium For Photochromic Material

The medium is preferably a high boiling solvent, a plasticizer, a synthetic resin, a hindered, i.e. sterically hindered, amine compound or a hindered, i.e. sterically hindered, phenol compound, with further preference given to a hindered amine compound or a combination of a hindered compound and another medium from the viewpoint of improvement in the color fastness to light of the organic photochromic compound.

Examples of the hindered phenol compound described above include the sterically hindered phenol compounds 2,6-di-t-butylphenol, 2,4,6-t-butylphenol, 2,6-di-t-butyl-p-cresol, 4-hydroxymethyl-2,6-di-t-butylphenol, 2,5-di-t-butyl hydroquinone, 2,2'-methylene-bis(4-ethyl-6-t-butylphenol) and 4,4'-butylidene-bis(3-methyl-6-t-butylphenol).

Examples of the hindered amine compound described above include the sterically hindered phenol compounds bis(2,2,6,6-tetramethyl-4-piperidyl)sebacate, bis(1,2,2,6,6-pentamethyl-4-piperidyl)sebacate, dimethyl succinate and 1-(2-hydroxyethyl)-4-hydroxy-2,2,6,6-tetramethylpiperidine polycondensation product, poly[{6-(1,1,3,3-tetramethylbutyl)amino-1,3,5-triazine-2,4-diyl}{2,2,6,6-tetramethyl-4-piperidyl)imino} hexamethylene(2,2,6,6-tetramethyl-4-piperidyl)imino], 2-(3,5-di-t-butyl-4-hydroxybenzyl)-2-n-butylmalonic acid bis(1,2,2,6,6-pentamethyl-4-piperidyl), 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetramethylpiperidine, 8-benzyl-7,7,9,9-tetramethyl-3-octyl-1,3,8-triazaspiro[4,5]undecane-2,4-dione and tetrakis(2,2,6,6-tetramethyl-4-piperidine)butanecarbonate.

Examples of the high boiling solvent described above include high-boiling or slow-evaporating kinds of alcohols, ketones, esters, ethers, aromatic (halogenated) hydrocarbons, aliphatic (halogenated) hydrocarbons, cellosolves, formamides and sulfoxys.

Examples of the plasticizer described above include all plasticizers such as phthalate-based plasticizers, adipate-based plasticizers, phosphate-based plasticizers, polyester-based plasticizers and polyether-based plasticizers.

Examples of the synthetic resin described above include acrylic polymers such as polyvinyl butyral, polyvinyl alcohol and polymethylmethacrylate; styrene polymers such as polystyrene and ABS; polyester polymers such as polycarbonate; polyether polymers such as polyethylene oxide; and other synthetic resins such as ethyl cellulose. polyvinyl acetate, polyvinyl chloride, epoxy resin and polyurethane resin.

Dyeing Method Treatment Steps

Dyeing of a cellulose fiber textile product by the dyeing method of the present invention can be achieved for example as follows:

The textile product described above is first scoured to remove sizing and impurities. Scouring is of course unnecessary when the textile product is clean.

Step A Cationic Compound Treatment Liquid

Next, to an appropriate dyeing bath vat, water in an amount 5 to 50 times the amount of the textile product (bath ratio=1:5 to 1:50), preferably 10 to 30 times (bath ratio=1:10 to 1:30), is added, and a cationic compound is added thereto in a ratio of about 0.1 to 20% by weight, preferably about 0.3 to 5% by weight, to the pretreatment textile product. An acid such as acetic, tartaric, oxalic or malic acid may be added to adjust the pH to the acidic side, or a wetting agent such as urea, glycerol, ethylene glycol, polyethylene glycol or diethylene glycol may be added to improve the permeability of the cationic compound into the textile product.

Next, the textile product described above is immersed in the aqueous solution thus obtained forming a cationic compound containing treatment liquid, and the temperature is gradually increased up to preferably about 50° to 80° C. and this temperature is maintained for about 5 to 30 minutes, whereby the cellulose fiber of the textile product is efficiently cationized.

Subsequently, this textile product is thoroughly rinsed to wash down the excess portion of the cationic compound and other additives and then dehydrated.

Step B Chromic Material (Dye) Dispersion Liquid

Next, to the bath vat containing the treated textile product, water is added in a ratio of about 1:5 to 1:50, preferably 1:10 to 1:30, relative to the pretreatment textile product, and the thermochromic material and/or photochromic material microcapsuled as described above is added and dispersed in a ratio of about 1 to 50% by weight, preferably 3 to 25% by weight, relative to the pretreatment textile product.

When dispersing these chromic materials in water, it is preferable to use as a dispersing agent an anionic surfactant, anionic polymer compound, amphoteric polymer compound or the like, which may be used in combination with a nonionic surfactant.

These are used in a ratio of 0.1 to 20 parts by weight, preferably 0.3 to 5 parts by weight to 100 parts of the chromic material described above.

The dispersion thus obtained forming a dispersion liquid containing a dispersion of reversibly color changeable chromic material (dye), is treated at normal temperature to about 90° C. for 5 to 30 minutes, whereby the thermochromic material and/or photochromic material is completely exhausted, i.e. completely taken up by physical adsorption, from the liquid into the cationized textile product described above. This treating temperature is preferably about 60° to 90° C. when using the chromic material described above at a high concentration of 10 to 50% by weight.

This treatment results in the binding of the chromic material described above to the textile product described above by chemical ion bond and physical adsorption. This product is then dehydrated and dried at normal temperature and heated at preferably about 80° to 180° C. for about 0.5 to 10 minutes, whereby the chromic material described above is firmly fixed to the textile product.

The textile product thus obtained has been dyed with the thermochromic material and/or photochromic material to a high density and in addition, it maintains a good texture and soft handling touch, and it is excellent in color fastness to rubbing and color fastness to washing.

Dispersing Agent

Examples of the anionic surfactant described above include alkyl sulfates, alkyl benzenesulfonates, alkyl naphthalenesulfonates, alkyl sulfosuccinates, alkyl diphenyl ether disulfonates, alkyl phosphates, polyoxyethylene alkyl sulfates, polyoxyethylene alkylallyl sulfates, polyoxyethylene alkyl ether sulfates, polyoxyethylene alkylphenyl ether sulfates, polyoxyethylene polystyrylphenyl ether sulfates and polyoxyethylene alkyl phosphates.

Examples of the anionic polymer compound described above include polyacrylic acid, poly-α hydroxyacrylic acid, methacrylic acid, copolymers of these substances with other vinyl polymers, ethylene/maleic anhydride copolymer, butylene/maleic anhydride copolymer, vinyl ether/maleic anhydride copolymer, anion-modified polyvinyl alcohol, gum arabic, carboxymethyl cellulose, hydroxyethyl cellulose, hydroxypropyl cellulose and starch derivatives.

Examples of the amphoteric polymer compound described above include gelatin and casein.

Examples of the nonionic surfactant described above include polyoxyethylene alkyl ether, polyoxyethylene alkylallyl ether and other polyoxyethylene derivatives, polyoxyethylene-polyoxypropylene block copolymer, aliphatic esters of sorbitan, fatty acid esters of polyoxyethylene sorbitol and fatty acid esters of glycerol.

The microcapsuled thermochromic material and/or photochromic material described above is preferably coated with the same anionic polymer compound or amphoteric polymer compound as the above indicated dispersing agents, by a known method such as the insight method, the coacervation method, atmospheric suspension method or the interfacial precipitation method, etc. This treatment not only further improves the heat resistance, rubbing resistance and solvent resistance but also makes it easier to obtain a uniform dispersion in water even in the absence of the anionic surfactant or anionic polymer compound or others, as a dispersing agent, since the coat of the microcapsule itself is dispersible. In this case, the amount of the anionic or amphoteric polymer compound used is preferably about 0.1 to 5% by weight of the entire weight of the microcapsule which incorporates the thermochromic material and/or photochromic material.

Preferred Dyeing Process (1)

As stated above, a preferred mode of the dyeing method of the present invention comprises (A) a process of treating a cellulose fiber textile product with a cationic compound, (B) another process of treating the thus-treated textile product by immersing it in a dispersion containing thermochromic material and/or photochromic material, and (C) still another process of further treating the textile product by subsequently adding a binder to the resultant dispersion in an amount insufficient to spoil the appearance and touch of the dyed product. The binder solid content can be 0.1 to 10% by weight relative to the textile product. The binder solid content is more preferably 0.3 to 5% by weight.

Binder

Examples of the binder described above include binders of acrylate resin, methacrylate resin, polyurethane resin, polyester resin, styrene-butadiene latex, polyolefin resin, vinyl chloride resin, vinylidene chloride resin and vinyl acetate resin and their derivatives and their copolymers. For the present invention, binders of acrylate resin and polyurethane resin are especially preferable.

Preferred Dyeing Method (2)

As stated above, another preferred mode of the dyeing method of the present invention comprises (A) a process of treating a cellulose fiber textile product with a cationic compound, (B) another process of treating the thus-treated textile product by immersing it in a dispersion containing thermochromic material and/or photochromic material, and (C) still another process of further treating the thus-treated textile product by immersing it in water containing a binder in an amount insufficient to spoil the appearance and touch of the dyed product. The binder solid content can be 0.1 to 10% by weight relative to the textile product. The binder solid content is more preferably 0.3 to 5% by weight.

This binder can be the same as above.

Dyeing a textile product by this method can be achieved, for example, as follows: The cellulose fiber textile product is treated with a cationic compound and immersed in a dispersion containing a thermochromic material and/or a photochromic material to thereby exhaust the chromic material into the textile product, followed by dehydration. To the bath vat, water is added in a bath ratio of about 5 to 50 times by weight, preferably 10 to 30 times by weight. A binder is added in a ratio of 0.1 to 10% by weight of binder solid content relative to the textile product described above, followed by treatment at normal temperature to about 90° C. for 5 to 30 minutes and dehydration and drying.

The textile product thus obtained shows further improvements in the color fastness to rubbing and color fastness to washing similarly as in the case described above.

Preferred Dyeing Method (3)

Furthermore, as stated above, still another preferred mode of the dyeing method of the present invention comprises (A) a process of treating a cellulose fiber textile product with a cationic compound, and (B) another process of treating the thus-treated textile product by immersing it in a dispersion containing together both (a) thermochromic material and/or photochromic material and (b) a binder in an amount insufficient to spoile the appearance and touch of the dyed product. The binder solid content can be 0.1 to 10% by weight relative to the textile product. More preferably, the binder solid content is 0.3 to 5% by weight.

This binder can be the same as above.

Dyeing a textile product by this method can be achieved, for example, as follows: The cellulose fiber textile product is treated with a cationic compound and immersed in a dispersion containing a thermochromic material and/or a photochromic material and a binder in a ratio of 0.1 to 10% by weight of binder solid content relative to the textile product and treated at normal temperature to about 90° C. for 5 to 30 minutes, followed by dehydration and drying.

The textile product thus obtained shows further improvements in the color fastness to rubbing and color fastness to washing similarly in the case described above.

Preferred Dyeing Method (4)

Still another preferred mode of the dyeing method of the present invention comprises (A) a process of treating a cellulose fiber textile product with a cationic compound and a binder in an amount insufficient to spoil the appearance and touch of the dyed product, and (B) another process of treating the thus-treated textile product by immersing it in a dispersion containing thermochromic material and/or photochromic material. The binder solid content can be 0.1 to 10% by weight relative to the textile product. More preferably, the binder solid content is 0.3 to 5% by weight.

When the binder is fixed to the textile product described above by one of the preferred modes described above, the binder is strongly fixed to the textile product by adhering it in a ratio of about 0.1 to 10% by weight of binder solid content relative to the textile product, followed by dehydration and drying. As a result, further improvements in the color fastness to rubbing and color fastness to washing are obtained. If the binder solid content is less than 0.1% by weight relative to the textile product, the obtained effect is likely to be insufficient. If the binder content exceeds 10% by weight, the appearance and touch of the textile are often spoiled.

Collateral Colorant

Furthermore, in the dyeing method of the present invention described above, the dispersion containing the thermochromic material and/or photochromic material may further contain a daylight fluorescent pigment and/or other inorganic or organic pigments, which may be exhausted into the textile product simultaneously with the chromic material.

This makes it possible to cause reversible color changes between a chromatic color and another chromatic color by changing the temperature or in the presence or absence of light irradiation.

In this case, any addition amount of the pigment described above can be selected as long as the total amount of the chromic material and pigment does not exceed 50% by weight of the textile product. It is preferable to use the pigment in a ratio of 0.5 to 10% by weight in the case of daylight fluorescent pigments, or 0.1 to 2% by weight in the case of other inorganic pigments or organic pigments.

Examples of daylight pigments include those prepared by coloring a formaldehyde condensation product of cyclic aminotriazine compound and aromatic monosulfamide compound as the base polymer with a fluorescent cation dye or dispersion dye. Other pigments include inorganic pigments such as iron oxide, chromium yellow, ultramarine blue, titanium dioxide and carbon black, and organic pigments such as azo pigments, anthraquinone pigments, lake pigments, dioxazine pigments and phthalocyanine pigments.

These pigments can be used in the form of a dispersion of fine grains having a diameter of 0.05 to 10 μm prepared by wet milling in water containing the anionic surfactant described above and the nonionic surfactant and wetting agent described above added as needed.

Also, in the presence of an anionic surfactant and if necessary a nonionic surfactant, a daylight fluorescent pigment obtained by coloring an aqueous emulsion polymer or suspension polymer of acrylonitrile and another polymerizable unsaturated vinyl compound with a fluorescent cationic dye or dispersion dye upon or after polymerization can be used as such, since it is about 0.05 to 10 μm in grain diameter.

Furthermore, it is also possible to pre-color the textile product and subject it to any one mode of the dyeing method of the present invention described above.

Accordingly, when any one of the dyeing methods described above is carried out after dyeing the textile product with a direct dye or acid dye or after basically dyeing the textile product with a pigment such as an organic pigment, inorganic pigment or daylight fluorescent pigment by resin padding, it is possible to cause reversible color changes between a chromatic color and another chromatic color by changing the temperature or in the presence or absence of light irradiation.

Some preparation examples for chromic material in the form of microcapsule and matrix are given below. In the following description, "part(s) by weight" are simply referred to as "part(s)".

PREPARATION EXAMPLE 1 preparation of thermochromic microcapsules

PSD-V (vermillion) (trade name, acid developing substance, product of Shinnisso Kako K.K.), 1 part
Bisphenol A, 2 parts
Bisbenzotriazole-5-methane, 2 parts
Stearyl laurate, 10 parts
Myristyl alcohol, 10 parts
Tinuvin 326 (trade name, ultraviolet absorbent, product of Chiba-Geigy AG), 2 parts
Epikote 828 (trade name, epoxy resin, product of Yuka Shell Epoxy Co.), 6 parts A hot uniform solution of the formulation described above was added to 200 parts of a 5% aqueous solution of gelatin at 60° C. and dispersed in the form of oil drops of 5 μm in diameter with stirring. Then, 4 parts of an epoxy resin hardener (EPICURE U (tradename), product of Yuka Shell Epoxy Co. was added, and stirring was continued and the temperature was increased to 90° C., followed by reaction for 2 hours. The solution was thereafter cooled, and the resulting microcapsule paste was washed and filtered to remove 90% by weight of the gelatin contained therein to yield 100 parts of a dispersion containing about 35 parts of thermochromic microcapsules and about 1 part of gelatin.

PREPARATION EXAMPLE 2 preparation of photochromic microcapsules 100 parts of a dispersion containing 35% by weight of photochromic microcapsules was obtained in the same manner as in Preparation Example 1 except that 1 part of 1,3,3-trimethylspiro[indolin-2,3'-[3H]naphtho(2,1-b)(1,4)oxazine] (organic photochromic compound) and 26 parts of bis(2,2,6,6-tetramethyl-4-piperidyl)sebacate were used in place of the PSD-V, bisphenol A, bisbenzotriazole-5-methane, stearyl laurate, myristyl alcohol and Tinuvin 326 used in Preparation Example 1.

PREPARATION EXAMPLE 3 preparation of thermochromic microcapsules

Y-1 (leuco dye (yellow), product of Yamamoto Kasei Co.), 1 part
Bisphenol A, 4 parts
Myristyl alcohol, 10 parts
Lauryl myristate, 10 parts
Tinuvin 326, 2 parts 150 parts of water, 7.5 parts of urea, and 20 parts of 37% formalin were mixed. This mixture was adjusted to a pH of 8 with 10% sodium carbonate and stirred at 70° C. for 1 hour to yield an aqueous solution containing an initial condensation product of urea and formamide.

Then, to this solution, a thermally dissolved mixture of the formulation described above was added dropwise with stirring, and stirring was continued at a stirring rate adjusted so that the grain diameter of this mixture became about 5 μm. Citric acid was added dropwise to adjust the solution to a pH of 5, and the solution was stirred at 70° C. for 2 hours. Citric acid was further added dropwise to adjust the solution to a pH of 3, and the solution was stirred at 80° C. for 2 hours, followed by washing with water, filtration and drying to yield about 40 parts of thermochromic microcapsules.

Next, 25 parts of the microcapsules described above were added to 100 parts of 2% by weight carboxymethyl cellulose, and this mixture was stirred to yield a uniform dispersion.

To this dispersion, 100 parts of 2% polyvinyl alcohol was added. After the temperature was increased to 40° C., 100 parts of 25% sodium chloride was gradually added with stirring, and the solution was subsequently cooled to 10° C., and 50% glutaraldehyde was added with additional stirring, followed by stirring for 15 hours.

After the temperature was increased to 40° C., the solution was stirred at 40° C. for 3 hours, followed by washing with water, filtration and drying to yield about 78 parts of microcapsules whose outer layer were coated with carboxymethyl cellulose.

PREPARATION EXAMPLE 4 preparation of photochromic microcapsules 1,3,3-triphenylspiro[indolin-2,3'-(3H)naphtho(2,1-b)pyran], 1 part SANOL LS-770 (trade name, hindered amine compound, product of Sankyo Co., Ltd.), 2 parts Polystyrene resin, 24 parts Toluene, 56 parts Polymethylenephenyl isocyanate (MILLIONATE MR (trade name, product of Nippon Polyurethane Industry Co., Ltd.), 10 parts This formulation was stirred in a sand grinder to yield a uniform solution.

Separately, 500 parts of an aqueous solution containing 2 parts of colloidal calcium phosphate were prepared, to which the uniform solution described above was added dropwise with stirring, followed by stirring for about 1 hour at an adjusted stirring rate to yield a suspension of uniform dispersion of about 5 μm in average grain size with almost the entire portion of the toluene evaporated.

Stirring was continued and 2 parts of xylylenediamine were added dropwise and the suspension was stirred for 3 hours, after which it was filtered, washed with water, and dried to yield about 38 parts of photochromic microcapsules.

PREPARATION EXAMPLE 5 preparation of photochromic microcapsules

Photochromic microcapsules were obtained in the same manner as in Preparation Example 4 except that 1 part of 8'-piperidino-1,3,3-trimethylspiro[indolin-2,3'-[3H]naphtho(2,1-b)(1,4)oxazine] and 26 parts of SANOL LS-770 were used in place of 1 part of 1,3,3-trimethylspiro[indolin-2,3'-[3H]naphtho(2,1-b)pyran], 2 parts of SANOL LS-770, 24 parts of polystyrene resin and 56 parts of xylene used in Preparation Example 4.

PREPARATION EXAMPLE 6 preparation of photochromic matrix fine particles

8'- piperidino-1,3,3-trimethylspiro[indolin-2,3'-[3H]naphtho(2,1-b)(1,4)oxazine] (organic photochromic compound), 1 part SANOL LS-770, 2 parts DIANOL SE-5377 (trade name, 40% by weight of polymethyl methacrylate resin, 60% by weight of xylene, product of Mitsubishi Resin Co., Ltd.), 60 parts Xylene, 20 parts A thermally dissolved mixture of the formulation described above was added dropwise to a 3% aqueous solution of styrene/maleic anhydride copolymer with stirring. Then the mixture was stirred at 80° to 90° C. for about 2 hours at an adjusted stirring rate to yield a suspension of uniform dispersion of the organic photochromic compound having about a 5 μm average grain size with almost the entire portion of the xylene evaporated. The suspension was washed with water, filtered and dried to yield 38.5 parts of photochromic matrix fine particles including about 0.5 part of styrene/maleic anhydride copolymer. In the matrix, the organic photochromic compound was dispersed uniformly.

EXAMPLES

Example 1

A cotton T-shirt (grey sheeting, 120 parts) was scoured to remove the sizing and impurities.

Next, 2400 parts of water (bath ratio = 1:20), 2 parts of SUNFIX PAC-7 (trade name, quaternary ammonium salt type cationic polymer compound, product of Sanyo Chemical Industries, Ltd.) and 10 parts of ethylene glycol were added to a 5-l vat, and this mixture was adjusted to a pH of about 4 with acetic acid.

The scoured T-shirt described above was immersed in this aqueous solution and gradually heated to 70° C., at which temperature it was treated for 15 minutes.

Subsequently, the T-shirt was thoroughly rinsed with water to remove the unfixed portion of the cationic compound and other additives, followed by dehydration.

Next, 2400 parts of water and 50 parts of a dispersion containing the thermochromic microcapsules obtained in Preparation Example 1 were added to this vat, and this solution was gradually heated to 80° C., at which temperature it was treated for 15 minutes.

This dispersion was pink before treatment, but it became a transparent colorless liquid after treatment (observation was made at 25° C.). This finding demonstrates that the thermochromic microcapsules was completely exhausted into the cotton T-shirt.

Subsequently, this T-shirt was thoroughly rinsed and dehydrated, after which it was allowed to dry and then subjected to heat treatment at 140° C. in a tumbler drier for 1 minute.

When the T-shirt thus obtained was worn, its entire surface changed in its color among white, distinct pink, pinkish white, etc. according to heat transmission from body temperature and minute changes in atmospheric temperature.

The appearance, handling touch, color fastness to rubbing and color fastness to washing of the T-shirt were all good.

Example 2 t was obtained in the same manner as in

A cotton T-shirt was obtained in the same manner as in Example 1 except that the photochromic microcapsules of Preparation Example 2 were used in place of the thermochromic microcapsules obtained in Preparation Example 1.

This T-shirt was found to be white under indoor conditions free of direct sun light, while it became dark blue at windows and outdoors under direct sun light. This change could be reversibly repeated in cycles, and the quality of the T-shirt was as good as in Example 1.

Example 3

First, a cotton T-shirt scoured in the same manner as in Example 1 was immersed in an aqueous solution of a bath ratio of 1:20 prepared by adding a direct dye (trade name, KAYARUS YELLOW F8G, product of Nippon Kayaku Co., Ltd.) to water in a ratio of 0.1%, and treated at 90° C. for 3 minutes to yield a yellow dyed T-shirt. This T-shirt was treated in the same manner as in Example 2 to fix the photochromic microcapsules.

This T-shirt was found to be yellow under indoor conditions free of direct sun light, while it changed its color to green at windows and outdoors under direct sun light. This change could be reversibly repeated in cycles, and the quality of the T-shirt was as good as in Examples 1 and 2.

Example 4

A cotton T-shirt (smooth knit, 150 parts) was scoured to remove the sizing and impurities.

Next, an aqueous solution containing 3000 parts of water (bath ratio=1:20), 1.5 parts of AMIGEN NF (trade name, quaternary ammonium salt type cationic polymer compound, product of Dai-ichi Kogyo Seiyaku Co., Ltd.) and 10 parts of ethylene glycol were added to a 5-l vat. The T-shirt described above was immersed in this solution and gradually heated to 60° C., at which temperature it was treated for 20 minutes.

Subsequently, this T-shirt was thoroughly rinsed with water and dehydrated. Next, 3000 parts of water and 22.5 parts of the photochromic microcapsules obtained in Preparation Example 4 were added to this vat, and this solution was gradually heated to 70° C., at which temperature it was treated for 15 minutes to exhaust the photochromic microcapsules into this T-shirt. Subsequently, this T-shirt was thoroughly rinsed with water and dehydrated, after which it was allowed to dry and then subjected to tumbler drying to yield a T-shirt on the entire surface of which the photochromic microcapsules were fixed.

This T-shirt was found to be totally white under indoor conditions free of direct sunlight, while it changed its color to dark yellow at windows and outdoors under direct sun light. This change could be reversibly repeated in cycles, and the quality of the T-shirt was as good as in Examples 1 through 3.

Example 5

Photochromic microcapsules were exhausted into a cotton T-shirt (150 parts, smooth knit), and the T-shirt was rinsed with water and dehydrated in the same manner as in Example 4.

Next, 3000 parts of water and 15 parts (solid content=about 4.5 parts) of BINDER MR-10 (trade name, acrylate resin binder, product of Matsui Shikiso Chemical Co., Ltd.) were added and this solution was gradually heated to 70° C., at which temperature it was treated 15 minutes and then dehydrated and dried.

The obtained T-shirt showed the same color changes as in Example 4 and had good appearance and touch. Moreover, the color fastness to rubbing and color fastness to washing were better than those of the T-shirt of Example 4.

COMPARATIVE EXAMPLE 1

A T-shirt as used in Example 4 was scoured and then immersed in a padding solution comprising 1300 parts of water, 300 parts of the photochromic microcapsules of Preparation Example 4 and 400 parts of BINDER MR-10 in a vat by the two-dip two-nip method and then dehydrated and allowed to dry.

This T-shirt was found to be white under indoor conditions free of sufficient light. When irradiated with sufficient light, this T-shirt changed its color to pale yellow, but this change was too minute to notice without careful watching, and it seemed to have no commercial value. In addition, the color fastness to rubbing and color fastness to washing were poorer than those of the T-shirt of Example 4.

Results of comparison of this T-shirt with the T-shirts obtained in Examples 4 and 5 are given in Table 1.

TABLE 1

| | Coloring density | Touch and appearance | Color fastness to rubbing | Color fastness to washing |
|---|---|---|---|---|
| Example 4 | 100 | Nearly the touch and appearance of cotton, with soft touch | Grade 3 | Grade 3 |
| Example 5 | 100 | Almost the same as in Example 4 | Grade 4 | Grade 4 |
| Comparative Example 1 | 20 | Hard | Grade 2 to 3 | Grade 2 to 3 |

In Table 1, the color fastness to rubbing and color fastness to washing were evaluated on the basis of Japan Industrial Standard JIS L-0849 and L-0844 Method A-2, respectively.

Example 6

Photochromic microcapsules were exhausted into a cotton T-shirt (150 parts, smooth knit) in the same manner as in Example 4 except that the photochromic microcapsules of Preparation example 5 were used in place of the photochromic microcapsules of Preparation example 4. Subsequently, 15 parts (solid content=about 4.5 parts) of BINDER MR-10 were added to the bath and the T-shirt was treated at 60° C. for 15 minutes, after which it was dehydrated and dried.

This T-shirt was found to be totally white under indoor conditions free of direct sun light, while it changed its color to dark purple at windows and outdoors under direct sun light.

This change could be reversibly repeated in cycles, and in addition the appearance, handling touch, color fastness to rubbing and color fastness to washing were as good as in Example 5.

Example 7

A T-shirt was cationized in the same manner as in Example 4.

Subsequently, this T-shirt was thoroughly rinsed with water and then dehydrated. Then, 3000 parts of water, 17.5 parts of the photochromic microcapsules of Preparation example 2 and 7.5 parts of Glow Pink M12G (trade name, water dispersion of pink daylight fluorescent pigment in the presence of an anionic surfactant, product of Matsui Shikiso Chemical Co., Ltd.) were added to this vat and dispersed, followed by the same procedure as in Example 4 to yield a T-shirt on the entire surface of which the photochromic microcapsules and the daylight fluorescent pigment were fixed.

This T-shirt was found to be totally yellow under indoor conditions free of direct sun light, while it changed its color to dark orange at windows and outdoors under direct sun light. This change could be reversibly repeated in cycles, and the quality of the T-shirt was as good as in Examples 1 through 3.

Example 8

First, a cotton trainer (300 parts) was scoured to remove the sizing and impurities.

Next, to a 10-l vat, 6000 parts of water, 2.7 parts of SUNFIX 70 (trade name, dicyanamide type cationic polymer compound, product of Sanyo Kasei Co., Ltd.)

and 15 parts of ethylene glycol were added, and the trainer described above was immersed in this solution and treated at 60° C. for 15 minutes and then thoroughly rinsed and dehydrated.

Next, 6000 parts of water were added to this vat, and 45 parts of the thermochromic microcapsules of Preparation example 3 were added and dispersed.

This dispersion was gradually heated to 70° C., at which temperature it was treated for 15 minutes, after which it was thoroughly rinsed and dehydrated. Then, 6000 parts of water were added and 30 parts (solid content=about 9 parts) of HYDRIN AP-20 (trade name, polyurethane resin emulsion, product of Dainippon Ink and Chemicals, Inc.) were added, and this solution was gradually heated to 70° C., at which temperature it was treated for 15 minutes, after which it was dehydrated and allowed to dry.

This trainer was found to be dark yellow at temperatures below about 25° C., but it became white at about 30° C. This change could be reversibly repeated in cycles. In addition, the appearance, handling touch, color fastness to rubbing and color fastness to washing of the trainer were all good.

Example 9

A cotton trainer (300 parts) was scoured and cationized in the same manner as in Example 8, after which it was thoroughly rinsed and dehydrated.

Next, 6000 parts of water were added to the vat containing this dehydrated cotton trainer, and 45 parts of the thermochromic microcapsules of Preparation example 3 and 30 parts of HYDRIN AP-20 were added and dispersed.

This dispersion was gradually heated to 80° C., at which temperature the cotton trainer was treated for 15 minutes, after which it was dehydrated and allowed to dry thoroughly.

This trainer showed the same color changes as in Example 8, and its appearance, touch, color fastness to rubbing and color fastness to washing were as good as in Example 8.

Example 10

First, a cotton trainer (300 parts) was scoured to remove the sizing and impurities.

Next, to a 10-l vat, 6000 parts of water, 2.7 parts of SUNFIX 70, 25 parts (solid content=about 9 parts) of CGC-102 (trade name, acrylate resin emulsion, product of Sumitomo Chemical Co., Ltd.) and 15 parts of ethylene glycol were added, and the trainer described above was immersed in this solution and treated at 70° C. for 15 minutes and then thoroughly rinsed and dehydrated.

Next, 6000 parts of water were added to this vat, and 45 parts of the thermochromic microcapsules of Preparation example 3 and 30 parts of MR-10 were added and dispersed.

This dispersion was gradually heated to 80° C., at which temperature it was treated for 15 minutes, after which it was thoroughly rinsed, dehydrated and allowed to dry Then, it was subjected to heat treatment at 130° C. for 3 minutes.

The obtained trainer showed the same color changes as in Examples 8 and 9. In addition, the appearance, touch, color fastness to rubbing and color fastness to washing of the trainer were all good.

Example 11

A trainer as used in Example 8 was scoured. 6000 parts of water and 6 parts of KAYARUS Rose FR (trade name, direct dye, product of Nippon Kayaku Co., Ltd.) were added to a vat, and this trainer was immersed therein and heated to 90° C., at which temperature it was uniformly treated for 5 minutes and then rinsed with water and dehydrated to dye this trainer blue.

Next, thermochromic capsules were fixed in the same manner as in Example 8.

This trainer was found to be orange at temperatures below about 25° C., but it changed its color to rose at about 30° C. This change could be reversibly repeated in cycles, and the quality of the trainer was as good as that of the trainer of Example 8.

COMPARATIVE EXAMPLES 2 THROUGH 5

The same procedures as in Examples 1, 2, 4 and 6 were followed except that no cationic compound was used.

The respective products thus obtained were found to have no commercial value because their coloring density was as low as about 10% in comparison with the clothes of the above said Examples.

With respect to the above examples, it will be noted that existing corresponding Technical Bulletins from the suppliers of certain of the trade name designated products indicate the following:

SANFIX PAC-7 (SUNFIX PAX-7), i.e. indicated in Examples 1–3 by its chemical constitution as a quaternary ammonium salt type cationic polymer compound, is a known fixing agent for dyes, which is cationic, pH 5—1% solution, water soluble liquid;

AMIGEN NF, i.e. indicated in Examples 4–7 by its chemical constitution as a quaternary ammonium salt type cationic polymer compound is a known fixing agent for dyes, which is a cationic, pH alkaline—1% solution, water soluble liquid;

SANFIX 70 (SUNFIX 70), i.e. indicated in Examples 8–11 by its chemical constitution as a dicyanamide type cationic polymer compound, is a known fixing agent for dyes, which is a cationic, pH 4—2% solution, water soluble cationic resin liquid; and CGC-102, i.e. indicated in Example 10 by its chemical constitution as an acrylate resin emulsion, is a known electrically conductive acrylate cation emulsion having a cationic particle charge, a 38.2% solid content special copolymer composition of pH 5.1 and a 0.24 micron particle size of excellent adhesion and adsorption to glass fiber and other anionic materials, and thus is a high cationic activity and electric conductivity binder.

What is claimed is:

1: Dyeing method comprising the steps of:

treating a cellulose fiber textile product with a nitrogenous cationic compound selected from the group consisting of quaternary ammonium salts, pyridinium salts, dicyandiamides, polyamines and polycations, in an aqueous treatment liquid for cationically treating the textile product, the cationic compound being capable of cationizing the cellulose fiber of the textile product and the treating being effected so that the cationic compound permeates the textile product and cationizes the cellulose fiber, and treating the thus-treated textile product by immersing it in an aqueous dispersion liquid containing thermochromic material encapsulated in polymer microcapsules and/or photochromic material encapsulated in polymer microcapsules or contained in particles of a polymer matrix, so that the encapsulated thermochromic material and/or encapsulated or matrix particle containing photochromic material binds to the cationically treated textile product by chemical ion bonding and physical adsorption, thus dyeing the cationically treated textile product therewith.

2. Dyeing method comprising the steps of:

treating a cellulose fiber textile product with a nitrogenous cationic compound selected from the group consisting of quaternary ammonium salts, pyridinium salts, dicyandiamides, polyamines and polycations, in an aqueous treatment liquid for cationically treating the textile product, the cationic compound being capable of cationizing the cellulose fiber of the textile product and the treating being effected so that the cationic compound permeates the textile product and cationizes the cellulose fiber, treating the thus-treated textile product by immersing it in an aqueous dispersion liquid containing thermochromic material encapsulated in polymer microcapsules and/or photochromic material encapsulated in polymer microcapsules or contained in particles of a polymer matrix, so that the encapsulated thermochromic material and/or encapsulated or matrix particle containing photochromic material binds to the cationically treated textile product by chemical ion bonding and physical adsorption, thus dyeing the cationically treated textile product therewith, and further treating the textile product by adding a resin binder to the dispersion liquid after the immersing, in an amount of about 0.1 to 10% by weight of binder solid content relative to the textile product, for also physically binding the encapsulated thermochromic material and/or encapsulated or matrix particle containing photochromic material by the binder to the textile product.

3. Dyeing method comprising the steps of:

treating a cellulose fiber textile product with a nitrogenous cationic compound selected from the group consisting of quaternary ammonium salts, pyridinium salts, dicyandiamides, polyamines and polycations, in an aqueous treatment liquid for cationically treating the textile product, the cationic compound being capable of cationizing the cellulose fiber of the textile product and the treating being effected so that the cationic compound permeates the textile product and cationizes the cellulose fiber, treating the thus-treated textile product by immersing it in an aqueous dispersion liquid containing thermochromic material encapsulated in polymer microcapsules and/or photochromic material encapsulated in polymer microcapsules or contained in particles of a polymer matrix, so that the encapsulated thermochromic material and/or encapsulated or matrix particle containing photochromic material binds to the cationically treated textile product by chemical ion bonding and physical adsorption, thus dyeing the cationically treated textile product therewith, and further treating the textile product by thereafter immersing it in water containing a resin binder in an amount of about 0.1 to 10% by weight of binder solid content relative to the textile product, for also physically binding the encapsulated thermochromic material and/or encapsulated or matrix particle containing photochromic material by the binder to the textile product.

4. Dyeing method comprising the steps of:

treating a cellulose fiber textile product with a nitrogenous cationic compound selected from the group consisting of quaternary ammonium salts, pyridinium salts, dicyandiamides, polyamines and polycations, in an aqueous treatment liquid for cationically treating the textile product, the cationic compound being capable of cationizing the cellulose fiber of the textile product and the treating being effected so that the cationic compound permeates the textile product and cationizes the cellulose fiber, and treating the thus-treated textile product by immersing it in an aqueous dispersion liquid containing (a) thermochromic material encapsulated in polymer microcapsules and/or photochromic material encapsulated in polymer microcapsules or contained in particles of a polymer matrix, so that the encapsulated thermochromic material and/or encapsulated or matrix particle containing photochromic material binds to the cationically treated textile product by chemical ion bonding and physical adsorption, thus dyeing the cationically treated textile product therewith, and (b) a resin binder in an amount of about 0.1 to 10% by weight of binder solid content relative to the textile product, for also physically binding the encapsulated thermochromic material and/or encapsulated or matrix particle containing photochromic material to the textile product.

5. Dyeing method comprising the steps of:

treating a cellulose fiber textile product with a nitrogenous cationic compound selected from the group consisting of quaternary ammonium salts, pyridinium salts, dicyandiamides, polyamines and polycations, and a resin binder in an amount of about 0.1 to 10% by weight of binder solid content relative to the textile product, in an aqueous treatment liquid for cationically treating the textile product with the cationic compound and also for treating the textile product with the resin binder, the catioinic compound being capable of cationizing the cellulose fiber of the textile product and the treating being effected so that the cationic compound permeates the textile product and cationizes the cellulose fiber, and treating the thus-treated textile product by immersing it in an aqueous dispersion liquid containing thermochromic material encapsulated in polymer microcapsules and/or photochromic material encapsulated in polymer microcapsules or contained in particles of a polymer matrix, so that the encapsulated thermochromic material and/or encapsulated or matrix particle containing photochromic material binds to the cationically treated textile product by chemical ion bonding and physical adsorption, thus dyeing the cationically treated textile product therewith, the resin binder being effective for also physically binding the encapsulated thermochromic material and/or encapsulated or matrix particle containing photochromic material by the binder to the textile product.

6. Dyeing method of claims 1, 2, 3, 4 or 5 wherein the encapsulated thermochromic material and/or encapsulated or matrix particle containing photochromic material is contained in the dispersion liquid in a ratio of 1 to 50% by weight relative to the textile product.

7. Dyeing method of claims 1, 2, 3, 4 or 5 wherein the encapsulated thermochromic material is a microcapsuled three-component mixture of an acid developing substance, an acidic substance and a solvent, the three-component mixture being disposed in the polymer microcapsules.

8. Dyeing method of claims 1, 2, 3, 4 or 5 wherein the encapsulated photochromic material is a microcapsuled organic photochromic material contained in a medium selected from the group consisting of high boiling solvents, plasticizers, synthetic resins, sterically hindered amine compounds and sterically hindered phenol compounds, said medium being disposed in the polymer microcapsules.

9. Dyeing method of claims 7 or 8 wherein the coat former for forming the polymer microcapsules that encapsulate the corresponding encapsulated material is a polymer compound selected from the group consisting of polyurea, polyamide, polyester, polyurethane, epoxy resin, urea resin, melamine resin, gelatin, ethyl cellulose, polystyrene and polyvinyl acetate.

10. Dyeing method of claim 9 wherein said polymer microcapsules are themselves further coated with a coating of an anionic polymer compound or an amphoteric polymer compound.

11. Dyeing method of claims 1, 2, 3, 4 or 5 wherein said dispersion liquid containing the encapsulated thermochromic material and/or encapsulated or matrix particle containing photochromic material further contains a pigment.

12. Dyeing method of claims 1, 2, 3, 4 or 5 wherein said textile product is colored with a pigment or dye in advance of said treating with said dispersion liquid.

13. Dyeing method of claims 2, 3, 4 or 5 wherein said binder is selected from the group consisting of acrylic ester resin binder, polyurethane resin binder, polyester resin binder, styrene-butadiene latex binder, chlorinated polyolefin resin binder, polyacrylic acid binder and methacrylic acid binder.

14. Dyeing method comprising the steps of:

cationizing the cellulose fiber portion of a cellulose fiber textile product by immersing said textile product in an aqueous solution of a nitrogenous cationic compound selected from the group consisting of quaternary ammonium salts, pyridinium salts, dicyandiamides, polyamines and polycations, in a ratio of 0.1 to 20% by weight relative to the pretreatment textile product in water in an amount 5 to 50 times by weight the amount of the textile product, and gradually increasing the temperature of the aqueous solution up to about 50° to 80° C. and maintaining this temperature for about 5 to 30 minutes, for cationically treating the textile product, the cationic compound being capable of cationizing the cellulose fiber of the textile product and the treating being effected so that the cationic compound permeates the textile product and cationizes the cellulose fiber, thoroughly rinsing the thus-treated textile product to wash down the excess portion of the cationic compound and other additives, and then dehydrating it, and thereafter incorporating polymer microcapsuled thermochromic material and/or polymer microcapsulated photochromic material in the textile product by treating the textile product at normal temperature to 90° C. for about 5 to 30 minutes while immersing the rinsed and dehydrated textile product in a dispersion of the microcapsuled thermochromic material and/or microcapsuled photochromic material in a ratio of 1 to 50% by weight relative to the pretreatment textile product in water in an amount of about 5 to 50 times by weight the amount of the pretreatment textile product, so that the microcapsuled thermochromic material and/or microcapsuled photochromic material binds to the cationically treated textile product by chemical ion bonding and physical adsorption, thus dyeing the cationically treated textile product therewith, wherein the coat former for forming the polymer microcapsules of the corresponding microcapsuled material is a polymer compound selected from the group consisting of polyurea, polyamide, polyester, polyurethane, epoxy resin, urea resin, melamine resin, gelatin, ethyl cellulose, polystyrene and polyvinyl acetate, and said polymer microcapsules are optionally themselves further coated with a coating of an anionic polymer compound or an amphoteric polymer compound.

15. The cellulose fiber textile product dyed by the method of claim 1.

16. The cellulose fiber textile product dyed by the method of claims 2, 3, 4 or 5.

17. The cellulose fiber textile product dyed by the method of claim 6.

18. The cellulose fiber textile product dyed by the method of claim 9.

19. The cellulose fiber textile product dyed by the method of claim 8.

20. The cellulose fiber textile product dyed by the method of claim 9.

21. The cellulose fiber textile product dyed by the method of claim 10.

22. The cellulose fiber textile product dyed by the method of claim 11.

23. The cellulose fiber textile product dyed by the method of claim 12.

24. The cellulose fiber textile product dyed by the method of claim 13.

25. The cellulose fiber textile product dyed by the method of claim 14.

26. Dyeing method comprising the steps of:

treating a cellulose fiber textile product with an aqueous treatment liquid containing a nitrogenous cationic compound for cationically treating the textile product, the cationic compound being capable of cationizing the cellulose fiber of the textile product and the treating being effected so that the cationic compound permeates the textile product and cationizes the cellulose fiber, and treating the cationically treated textile product with an aqueous dispersion liquid containing a dispersion of temperature dependent reversibly color changeable thermochromic material encapsulated in polymer microcapsules and/or light dependent reversibly color changeable photochromic material encapsulated in polymer microcapsules or contained in particles of a polymer matrix for dyeing the product with said color changeable material such that the encapsulated thermochromic material and/or encapsulated or matrix particle containing photochromic material bonds to the cationically treated textile product by chemical ion bonding and physical adsorption, thus dyeing the cationically treated textile product therewith, wherein the nitrogenous cationic compound is selected from the group consisting of quaternary ammonium salts, pyridinium salts, dicyandiamides, polyamines and polycations, the encapsulated thermochromic material is a microcapsuled three-component mixture of an acid developing substance, an acidic substance and a solvent, the three-component mixture being disposed in the polymer microcapsules, the encapsulated photochromic material is a microcapsuled organic photochromic material contained in a medium selected from the group consisting of high boiling solvents, plasticizers, synthetic resins, sterically hindered amine compounds and sterically hindered phenol compounds, said medium being disposed in the polymer microcapsules, the coat former for forming the polymer microcapsules that encapsulate the corresponding encapsulated material is a polymer compound selected from the group consisting of polyurea, polyamide, polyester, polyurethane, epoxy resin, urea resin, melamine resin, gelatin, ethyl cellulose, polystyrene and polyvinyl acetate, and the microcapsules are optionally themselves further coated with a coating of an anionic polymer compound or an amphoteric polymer compound.

27. Method of claim 26 wherein said color changeable material is included in the dispersion liquid in a ratio of about 1 to 50% by weight relative to the textile product.

28. Method of claim 26 including treating the textile product with a resin binder for also physically binding the encapsulated thermochromic material and/or encapsulated to matrix particle containing photochromic material to the textile product, the binder being selected from the group consisting of acrylic ester resin binder, polyurethane resin binder, polyester resin binder, styrene-butadiene latex binder, chlorinated polyolefin resin binder, polyacrylic acid binder and methacrylic acid binder, and the binder being used in an amount of about 0.1 to 10% by weight of binder solid content relative to the textile product.

29. Method of claim 28 wherein the textile product is treated with the binder after the textile product has been dyed by treating with the encapsulated thermochromic material and/or encapsulated or matrix particle containing photochromic material.

30. Method of claim 29 wherein the binder is added to the residual dispersion liquid after the textile product has been dyed by treating with the encapsulated thermochromic material and/or encapsulated or matrix particle containing photochromic material, and the thus dyed textile product is thereafter treated with the resulting binder containing residual dispersion liquid.

31. Method of claim 29 wherein the binder is used in the form of a mixture thereof with water for treating the textile product therewith.

32. Method of claim 28 wherein the binder is added to the dispersion liquid before the textile product is dyed by treating with the encapsulated thermochromic material and/or encapsulated or matrix particle containing photochromic material, and the textile product is thereafter treated with the dispersion liquid containing the encapsulated thermochromic material and/or encapsulated or matrix particle containing photochromic material and binder for dyeing the textile product with the encapsulated thermochromic material and/or encapsulated or matrix particle containing photochromic material and for binding the encapsulated thermochromic material and/or encapsulated or matrix particle containing photochromic material to the textile product by the binder.

33. Method of claim 28 wherein the binder is added to the treatment liquid before the textile product is cationically treated with the cationic compound, and the textile product is thereafter treated with the cationic compound, and binder containing treatment liquid for cationically treating the textile product and for binding the encapsulated thermochromic material and/or encapsulated or matrix particle containing photochromic material to the textile product upon treating the textile product with the dispersion liquid for thusly dyeing the product.

34. Dyed product made by the method of claim 26.

35. Dyed product made by the method of claim 28.

36. Dyed product made by the method of claim 29.

37. Dyed product made by the method of claim 30.

38. Dyed product made by the method of claim 31.

39. Dyed product made by the method of claim 32.

40. Dyed product made by the method of claim 33.

* * * * *

UNITED STATES PATENT AND TRADEMARK OFFICE

CERTIFICATE OF CORRECTION

PATENT NO. : 5,221,288

DATED : June 22, 1993

INVENTOR(S) : Kamata et al.

It is certified that error appears in the above-identified patent and that said Letters Patent is hereby corrected as shown below:

At column 22, claim 18 should be changed to read as follows:

18. The cellulose textile product dyed by the method of claim ~~9~~ 7.

Signed and Sealed this

Twenty-seventh Day of September, 1994

*Attest:*

Bruce Lehman

BRUCE LEHMAN

*Attesting Officer*

*Commissioner of Patents and Trademarks*